US010734151B2

(12) United States Patent
Schekulin et al.

(10) Patent No.: US 10,734,151 B2
(45) Date of Patent: Aug. 4, 2020

(54) TRANSFORMER AND ASSOCIATED PRODUCTION METHOD

(75) Inventors: Dirk Schekulin, Arbon (CH); Silvia Gross-Kaeufler, Romanshorn (CH); Chriss Haertsch, Flawil (CH); Thomas Bisig, Romanshorn (CH); Alex Itten, Romanshorn (CH); Piere Cavin, Weinfelden (CH)

(73) Assignee: Schmidhauser AG, Romanshorn (CH)

( * ) Notice: Subject to any disclaimer, the term of this patent is extended or adjusted under 35 U.S.C. 154(b) by 153 days.

(21) Appl. No.: 14/342,517

(22) PCT Filed: Aug. 20, 2012

(86) PCT No.: PCT/EP2012/066207

§ 371 (c)(1),
(2), (4) Date: May 15, 2014

(87) PCT Pub. No.: WO2013/030031

PCT Pub. Date: Mar. 7, 2013

(65) Prior Publication Data

US 2014/0300438 A1 Oct. 9, 2014

(30) Foreign Application Priority Data

Sep. 2, 2011 (DE) ..... 10 2011 082 046

(51) Int. Cl.
*H01F 27/08* (2006.01)
*H01F 27/28* (2006.01)
(Continued)

(52) U.S. Cl.
CPC ..... *H01F 27/085* (2013.01); *H01F 27/2823* (2013.01); *H01F 27/2876* (2013.01);
(Continued)

(58) Field of Classification Search
CPC ..... H01F 30/06; H01F 17/045; H01F 29/146; H01F 19/04; H01F 27/34; H01F 27/085; H01F 27/346; H01F 27/2876; H01F 41/04
(Continued)

(56) References Cited

U.S. PATENT DOCUMENTS 3,648,208 A * 3/1972 Rolf ..... H01F 5/02 336/208
4,200,853 A 4/1980 de Jong et al.
(Continued)

FOREIGN PATENT DOCUMENTS

CN 2226335 Y 5/1996
CN 2410721 Y 12/2000
(Continued)

OTHER PUBLICATIONS

Machining, Google NPL—Wikipedia.*
International Search Report dated Nov. 19, 2012 with English translation (seven (7) pages).

*Primary Examiner* — Elvin G Enad
*Assistant Examiner* — Kazi S Hossain
(74) *Attorney, Agent, or Firm* — Crowell & Moring LLP

(57) ABSTRACT

A transformer for switched-mode power supplies includes a magnetizable core having a winding axis, at least one primary winding, which is formed by a primary winding conductor which at least partly surrounds the winding axis of the core, and at least one secondary winding, which is formed by a secondary winding conductor. The secondary winding conductor surrounds the primary winding conductor. The secondary winding is formed in one layer, and a cross section of the secondary winding conductor is rectangular, in particular square.

12 Claims, 2 Drawing Sheets

(51) Int. Cl.
*H01F 27/34* (2006.01)
*H01F 41/04* (2006.01)

(52) U.S. Cl.
CPC ..... *H01F 27/346* (2013.01); *H01F 41/04* (2013.01); *Y10T 29/4902* (2015.01)

(58) Field of Classification Search
USPC ..... 336/61, 183, 220, 55, 57
See application file for complete search history.

(56) References Cited

U.S. PATENT DOCUMENTS 5,175,525 A 12/1992 Smith
5,210,513 A * 5/1993 Khan ..... H01F 27/22 336/233
6,087,916 A * 7/2000 Kutkut ..... H01F 27/22 336/195
6,344,786 B1 * 2/2002 Chin ..... H01F 27/06 336/192
6,392,519 B1 * 5/2002 Ronning ..... H01F 27/22 336/61
6,815,618 B2 11/2004 Runge
6,909,349 B1 * 6/2005 Longardner ..... F25B 15/00 29/602.1
7,199,569 B1 * 4/2007 Nakahori ..... H02M 3/335 323/355
2008/0079524 A1 * 4/2008 Suzuki ..... H01F 27/2804 336/61
2008/0211613 A1 * 9/2008 Lin ..... H01F 27/2866 336/83
2009/0079528 A1 * 3/2009 Shabany ..... H01F 27/22 336/61
2009/0261934 A1 10/2009 Wolfgram
2009/0309684 A1 * 12/2009 Tsai ..... H01F 27/2866 336/105
2010/0207714 A1 8/2010 Lai et al.
2011/0121930 A1 * 5/2011 Takeuchi ..... H01F 17/04 336/96
2012/0268227 A1 * 10/2012 Howes ..... F28D 15/0266 336/57
2012/0293290 A1 * 11/2012 Kido ..... H01F 27/10 336/60
2012/0299678 A1 * 11/2012 Inaba ..... H01F 37/00 336/61
2012/0306605 A1 * 12/2012 Moiseev ..... H01F 27/22 336/55

FOREIGN PATENT DOCUMENTS

CN 101859635 A 10/2010
DE 23 30 300 A1 1/1975
DE 28 23 779 A1 12/1978
DE 197 25 865 A1 1/1998
DE 197 23 958 A1 12/1998
DE 199 59 732 A1 6/2001
DE 101 27 556 A1 12/2002
DE 603 01 336 T2 6/2006
EP 0 293 617 A1 12/1988
GB 1 420 290 A 1/1976
JP 8-130127 A 5/1996
WO WO 03/065388 A1 8/2003
WO WO 2010/090534 A2 8/2010

* cited by examiner

TRANSFORMER AND ASSOCIATED PRODUCTION METHOD

BACKGROUND AND SUMMARY OF THE INVENTION

The invention relates to a transformer and an associated production method.

High-frequency transformers for high output currents are predominantly planar constructions with stamped laminations for the secondary winding. The primary winding is usually likewise laminated or is also produced with stranded wire.

The correct electrical connection of the laminations to one another is associated with high outlay.

A further problem is the cooling of the component, since the heat loss of the windings has to be removed predominantly through a surrounding ferrite core. Ferrite material is a poor thermal conductor however, and a thermal connection over the entire surface on both sides to a heat sink is difficult to implement.

The implementation of the necessary insulation clearances without excessive enlargement of the leakage inductances is additionally problematic.

The object of the invention is to provide a transformer and an associated production method, which enable efficient cooling of the transformer with the lowest possible outlay.

The invention achieves this object by providing a transformer, and a production method therefor, for switched-mode power supplies. The transformer includes a magnetizable core having a winding axis, at least one primary winding, which is formed by a primary winding conductor that at least partly surrounds the winding axis of the core, and at least one secondary winding, which is formed by a secondary winding conductor. The secondary winding conductor surrounds the primary winding conductor, and is formed in one layer. A cross section of the secondary winding conductor is rectangular, in particular, square.

The transformer is preferably suitable or intended for switched-mode power supplies and has: a magnetic or magnetizable core, in particular a ferrite core, which defines a winding axis or has a winding axis, at least one primary winding, which is formed by a primary winding conductor, in particular in the form of a litz wire that is insulated a number of times, and which at least partly surrounds the winding axis of the core or a limb of the core, through which the winding axis runs, and at least one secondary winding, which is formed by a secondary winding conductor. The secondary winding conductor surrounds the primary winding conductor, that is to say the secondary winding conductor and the primary winding conductor form different winding layers over the winding axis. The secondary winding is formed in one layer, and a cross section of the secondary winding conductor is rectangular, in particular, square. Due to the cross section and the resultant outer contour, the secondary winding can be coupled very easily and with low thermal resistance to a cooling surface, for example. The cross section of the winding, which is solid in particular, or of the solid conductor, is intentionally overdimensioned here, such that an efficient heat flow is possible within the winding.

In an embodiment the secondary winding conductor is solid, that is to say the entire cross section of the conductor is filled with conductor material, or the conductor is filled completely with conductor material within its outer dimension. The conductor in particular is not constructed by interwoven stranded wires, by a plurality of combined individual conductors, or in the form of a hollow conductor or the like.

In an embodiment the at least one secondary winding is formed from a solid material block, which is structured to form the secondary winding conductor, in particular is structured by drilling, cutting and/or milling. Alternatively, the at least one secondary winding is formed from a diecast shaped article.

In an embodiment the transformer has a nominal output, wherein the (minimum) cross section of the secondary winding conductor is dimensioned in such a way that a current-carrying capacity of the secondary winding conductor is greater than is necessary for the nominal output, that is to say the cross section of the conductor is overdimensioned in relation to the nominal output.

In an embodiment the secondary winding conductor consists of copper or titanium, particularly preferably of aluminum.

In an embodiment a planar cooling element is provided, which is thermally coupled to the secondary winding, in particular to the side of the secondary winding facing away from the winding axis of the core. A heat-conductive electric insulator is preferably provided and is arranged between the cooling element and the secondary winding. The electric insulator is preferably an electrically insulating heat-conductive foil.

In accordance with the invention, the secondary winding or the secondary winding conductor forms a thermal bridge to the planar cooling element. Core losses and losses of the primary winding(s) pass initially to the secondary winding(s), for example in order to then be removed via the planar cooling element in the form of a water-cooled cooling plate.

In an embodiment the secondary winding forms a heat sink.

In an embodiment a distance between the primary winding and the core and a distance between the secondary winding and the primary winding are selected in such a way that leakages are minimized. In other words, the primary winding lies as tightly as possible over the core and the secondary winding lies as tightly as possible over the primary winding, such that there are minimal losses caused by leakage fields and good thermal coupling of the system is also achieved.

In the method for producing the above-mentioned transformer, the secondary winding is formed from a solid material block, which is structured to form the conductor, in particular as a result of material removing machining in the form of drilling, cutting and/or milling.

The invention will be described hereinafter with reference to the drawings, which illustrate preferred embodiments of the invention.

DETAILED DESCRIPTION OF THE DRAWINGS

Figure 1:
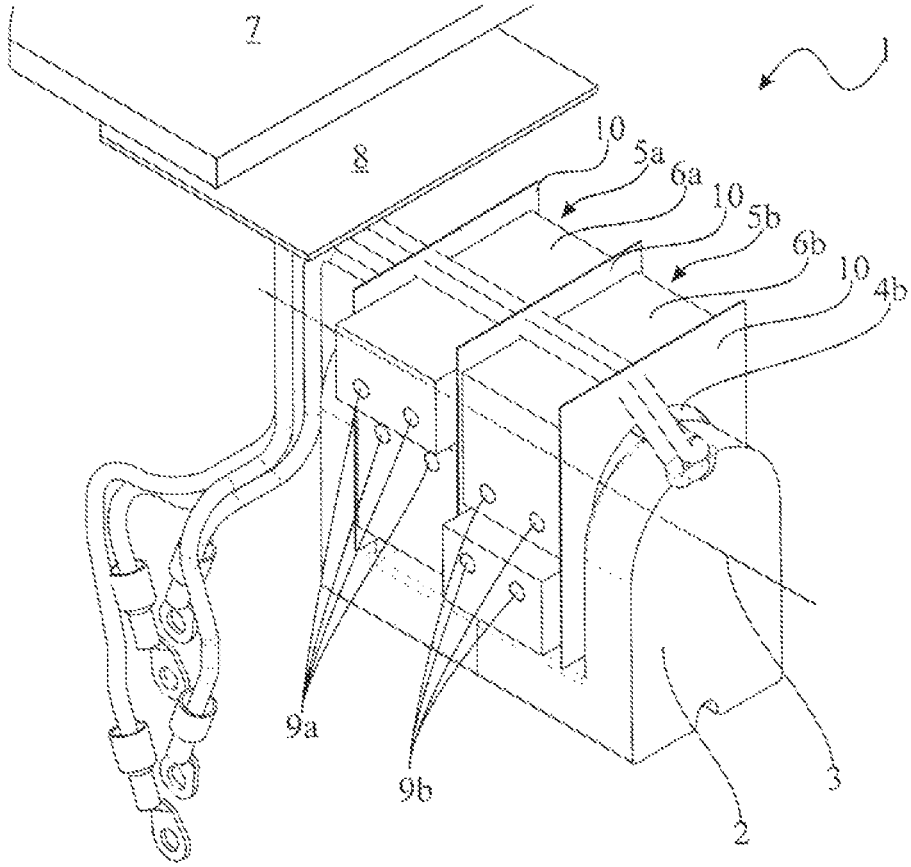
FIG. 1 shows schematically an illustration of a transformer according to the invention.

FIG. 1 shows a transformer 1 for switched-mode power supplies comprising a magnetizable ferrite core 2 having a limb that defines a winding axis 3, a first primary winding 4*a* (see FIG. 2), which is formed by a first primary winding conductor made of litz wires that are insulated a number of times and which directly surrounds the winding axis 3 of the core 2, a second primary winding 4*b*, which is formed by a second primary winding conductor made of litz wires that are insulated a number of times and which directly surrounds the winding axis 3 of the core 2. The first primary winding 4*a* and the second primary winding 4*b* are arranged axially adjacently on the limb. A first solid secondary winding 5*a* is made of aluminum and is formed by a first secondary winding conductor 6*a*, and a second solid secondary winding 5*b* is made of aluminum and is formed by a second secondary winding conductor 6*b*.

Furthermore, bores 9*a* and 9*b* are provided as connection points for the first and second secondary winding 5*a* and 5*b*, respectively.

Insulation elements 10 serve to electrically insulate between the primary and secondary circuit.

The secondary winding conductors 6*a* and 6*b* surround their associated primary winding conductors, such that they are arranged axially adjacently over the limb. The secondary winding conductors 6*a* and 6*b* are each formed in one layer and each have, in the winding direction, a rectangular cross section which is changeable in the winding direction.

The transformer has a specific nominal output, wherein the cross section of the secondary winding conductors 6*a* and 6*b* is dimensioned in such a way that the current-carrying capacity thereof is greater than is necessary for the nominal output.

For efficient cooling, a planar cooling element 7 is further provided, which is to be thermally coupled to the side or surface of the secondary windings 5*a* and 5*b* facing away from the winding axis 3 of the core 2. A heat-conductive electric insulator in the form of an electrically insulating heat-conductive foil 8 is provided between the cooling element 7 and the secondary windings 5*a* and 5*b*. Corresponding cooling elements can be provided on the upper face and/or the lower face of the secondary windings 5*a* and 5*b*.

The secondary windings 5*a* and 5*b* are each formed from a solid aluminum material block, which is suitably structured by drilling, cutting, electric discharge machining and/or milling.

The cross section of the secondary winding conductors 6*a* and 6*b*, or the minimum cross section thereof over the entire winding, is dimensioned in such a way that, at a given working frequency, the effective replacement area (skin depth) due to the skin effect is much smaller than the geometric cross section of the solid secondary winding conductors 6*a* and 6*b*. The dominating alternating current loss thus flows in the outer region of the winding in the direction of the core region of the winding and lastly along the winding to the heat sink in the form of the cooling element 7.

Figure 2:
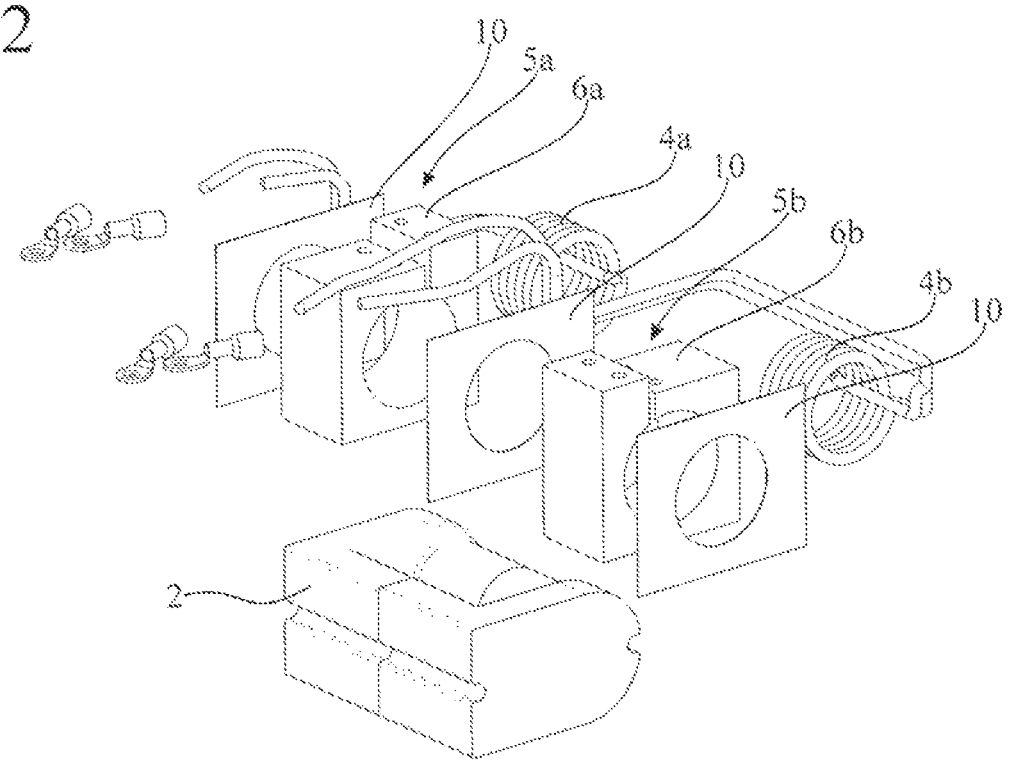
FIG. 2 shows schematically an exploded illustration of the transformer shown in FIG. 1.

FIG. 2, for clarification, shows an exploded illustration of the transformer shown in FIG. 1.

Figure 3:
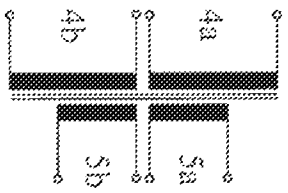
FIG. 3 shows schematically an electric equivalent circuit of the transformer shown in FIGS. 1 and 2.

FIG. 3 shows an electric equivalent circuit of the transformer 1 shown in FIGS. 1 and 2 with the primary windings 4*a* and 4*b* and the secondary windings 5*a* and 5*b*.

The embodiments shown have solid secondary-side windings 5*a* and 5*b*, which lie directly over the primary windings 4*a* and 4*b*, respectively, which are formed from litz wires insulated a number of times. The primary windings 4*a* and 4*b* are arranged with minimal spacing over the ferrite core 2.

Due to straight surfaces of the solid secondary windings 5*a* and 5*b*, a simple and efficient coupling to the cooling surface 7 is possible. The (minimum) cross section of the solid secondary windings 5*a* and 5*b* is intentionally overdimensioned here in order to thus achieve an efficient heat flow within the secondary windings 5*a* and 5*b*. The windings 5*a* and 5*b* are insulated with respect to the cooling area 7 by way of a thin heat-conductive foil 8 or ceramic material.

Due to the minimal distances between the windings 4*a*, 4*b*, 5*a* and 5*b* and the transformer core 2, optimal cooling is ensured on the one hand, and on the other hand the leakages are minimized or the coupling between the primary and secondary side is maximized.

The shown embodiments enable simple cooling of the transformer 1 via the solid secondary windings 5*a* and 5*b*, which can be effectively thermally coupled.

The transformer core 2 may likewise be thermally coupled very easily, such that optimal cooling of the overall component is possible. Furthermore, due to the large cross section of the secondary windings 5*a* and 5*b*, aluminum can be used, which saves weight and costs.

The transformer 1 for switched-mode power supplies has at least one solid (secondary) winding, the cross section of which is selected in such a way that a transport of the heat loss produced during operation to a planar heat sink is possible without the need for additional coolants.

Of course, just one individual primary and secondary winding or more than two primary and secondary windings may also be provided.

The invention claimed is:

1. A transformer for switched-mode power supplies, the transformer comprising:

a magnetizable core having a single winding axis;

at least one primary winding formed by a primary winding conductor at least partly surrounding the winding axis of the core;

at least one secondary winding formed by a secondary winding conductor, wherein the secondary winding conductor surrounds the primary winding conductor, the secondary winding is formed in one layer, and a cross section of the secondary winding conductor is rectangular, and a planar cooling element arranged parallel to the winding axis of the core and extending over the at least one secondary winding in the direction of the winding axis of the core, wherein the planar cooling element is thermally coupled to the at least one secondary winding on a side of the at least one secondary winding facing radially away from the winding axis of the core, wherein a region of the magnetizable core axially overlapped by the at least one secondary winding is not directly thermally coupled to the planar cooling element by a conductive heat transfer path that bypasses the at least one secondary winding.

2. The transformer according to claim 1, wherein the cross section of the secondary winding conductor is square.

3. The transformer according to claim 1, wherein the secondary winding conductor is solid.

4. The transformer according to claim 3, wherein the at least one secondary winding is formed from a solid material block, structured to form the secondary winding conductor, and the structuring of the solid material block is carried out by material removing machining.

5. The transformer according to claim 4, wherein the material removing machining is at least one of drilling, cutting, milling or electric discharge machining.

6. The transformer according to claim 1, wherein the at least one secondary winding is formed from a diecast shaped article.

7. The transformer according to claim 1, wherein the transformer has a nominal output, the cross section of the secondary winding conductor being dimensioned such that a current-carrying capacity of the secondary winding conductor is higher than necessary for the nominal output.

8. The transformer according to claim 1, wherein the secondary winding conductor is formed of aluminum, copper, or titanium.

9. The transformer according to claim 1, further comprising:

a heat-conductive electric insulator arranged between the cooling element and the secondary winding.

10. The transformer according to claim 9, wherein the electric insulator is an electrically insulating heat-conductive foil.

11. The transformer according to claim 1, wherein the secondary winding forms a heat sink.

12. The transformer according to claim 1, wherein a distance between the primary winding and the core and a distance between the secondary winding and the primary winding are selected to minimize leakages.

* * * * *